United States Patent [19]

Bowden

[11] 4,166,534

[45] Sep. 4, 1979

[54] PACKAGING ARTICLES

[76] Inventor: James Bowden, 38 Mill Ct., Rutherglen, Glasgow, Scotland

[21] Appl. No.: 862,598

[22] Filed: Dec. 20, 1977

[30] Foreign Application Priority Data

Dec. 23, 1976 [GB] United Kingdom ..... 53928/76

[51] Int. Cl.[2] ..... B65D 75/52

[52] U.S. Cl. ..... 206/429; 206/156; 206/193; 229/28 R; 229/40

[58] Field of Search ..... 229/15, 27, 28 R, 40; 206/153, 155, 156, 157, 160, 192, 193, 194, 195, 427, 429, 434

[56] References Cited

U.S. PATENT DOCUMENTS

| | | | |
|---|---|---|---|
| 2,889,957 | 6/1959 | Kilmartin | 206/193 |
| 2,974,851 | 3/1961 | Struble | 229/40 |
| 3,182,794 | 5/1965 | Moore | 229/40 |
| 3,186,587 | 6/1965 | Englander et al. | 206/194 |
| 3,688,969 | 9/1972 | Gabaqez | 206/427 |

FOREIGN PATENT DOCUMENTS

| | | | |
|---|---|---|---|
| 1145091 | 3/1963 | Fed. Rep. of Germany | 206/194 |
| 1290250 | 3/1962 | France | 206/195 |
| 1466565 | 12/1966 | France | 206/194 |
| 384461 | 2/1965 | Switzerland | 206/194 |
| 1261089 | 1/1972 | United Kingdom | 206/194 |

*Primary Examiner*—Herbert F. Ross

*Attorney, Agent, or Firm*—Larson, Taylor and Hinds

[57] ABSTRACT

A number of articles, such as jars, are packaged in a sleeve made from a blank of foldable sheet material. The blank comprises a top panel, a number of spaced apart side forming panels, a pair of strip panels hingedly joining the side forming panels and opposite pairs of bottom forming panels provided by the sheet material between adjacent side forming panels as extensions of the strip panels. The top panel abuts one end of the jars; the side panels extend alongside the jars so that the jars are visible in the space between them; and the strip panels are turned outwards so that the bottom forming panels of each pair project mutually inwards and overlap in abutment with the other end of the jar.

18 Claims, 10 Drawing Figures

PACKAGING ARTICLES

FIELD OF THE INVENTION

This invention relates to the packaging of articles, and particularly where the articles are to be visible when packaged.

SUMMARY OF THE INVENTION

One aspect of the present invention provides a blank of foldable sheet material for forming into a sleeve for packaging an article, the blank having a top forming panel, a plurality of spaced apart side forming panels hinged to each side of the top forming panel, and a pair of strip panels hingedly joining the side forming panels, opposite pairs of bottom forming panels being provided by the sheet material between adjacent side forming panels as extensions of the strip panels.

A second aspect of the invention provides a package comprising an article contained within a sleeve made from a blank as described above, the top panel abutting one end of the article, the side panels extending therefrom alongside the article so that the article is visible in the space between them, the strip panels being turned outwardly so that the bottom forming extension panels thereof project mutually inwardly to abut the other end of the article. The bottom forming panels preferably overlap each other, and can be secured together if desired, for example by adhesive or by interlocking means.

In a preferred form, the blank has more than two side forming panels on each side of the top forming panel, so that two or more articles can be packaged side by side, with each article visible between adjacent spaced apart side forming panels. The articles to be packaged are preferably cylindrical, for example jars or cans. The package can be overwrapped if desired, for example by shrink wrapping.

BRIEF DESCRIPTION OF THE DRAWINGS AND DESCRIPTION OF PREFERRED EMBODIMENTS

In order that the invention may be more clearly understood, one embodiment will now be described with reference to the accompanying drawings, wherein.

Figure 1:
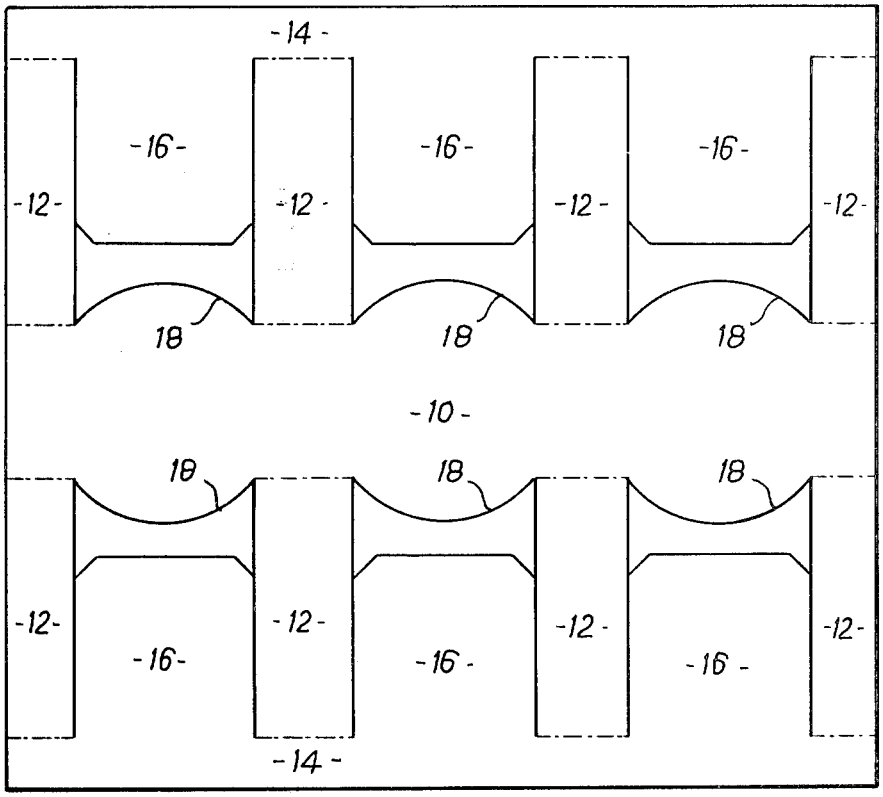
FIG. 1 shows the blank of the packaging sleeve.

Referring to the drawings, and firstly to FIG. 1; the blank is made from foldable sheet material such as cardboard, and comprises a top forming panel 10, arranged to overlie article 20 of a given width, a plurality of side forming panels 12 hinged along first hinge lines to each side of the top forming panel, and a pair of strip panels 14 on opposite sides of the blank and hingedly joining the side forming panels along second hinge lines. The side forming panels are equidistantly spaced apart along each side, and part of the sheet material from between adjacent side forming panels provides bottom forming panels 16 as extensions of the strip panels 14. The top forming panel has arcuate sides 18 between the side forming panels so as to match the circular tops of cylindrical articles to be packaged, but this feature is not essential.

Figure 2:
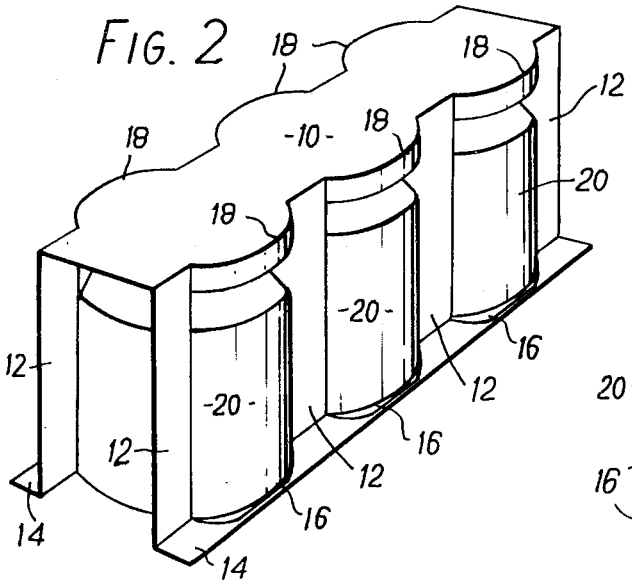
FIG. 2 shows a package comprising the blank enclosing a set of articles.
Figure 3:
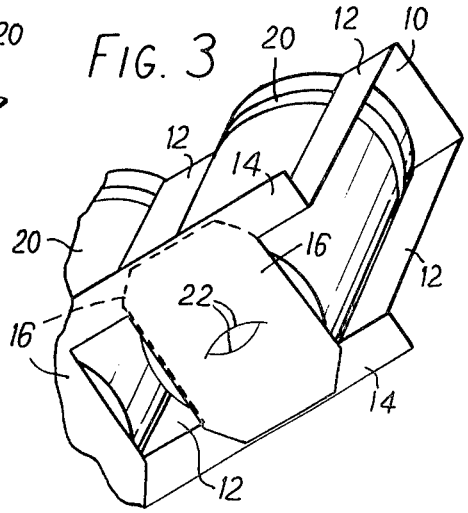
FIG. 3 shows a perspective view from below of part of the package.

To make up the package, a set of three articles, in this case jars 20, are arranged side by side and spaced apart, and the blank is placed over the jars so that the top panel 10 rests on the tops of the jars. The side panels 12 are then folded downwardly along the first hinge lines and at the same time the strip panels 14 are folded outwardly along second hinge lines so that the bottom forming panels 16 slide under the bottoms of the jars. The bottom forming panels are sufficiently large that they overlap. The distance between the hinge lines of opposite side forming panels on the top panel is less than the diameter of the jars, so that, as can be seen from FIG. 2, the sides of the jars project somewhat through the spaces between adjacent side forming panels 12, and thereby locate it in position and also expose the sides of the jars. The top of the jars are fully covered by the top panel, and the width of the strip panels 14 is such that they project laterally from the side wall panels to the same as do the sides of the jars. Thus, the bottoms of the jars are fully covered by the bottom forming panels and strip panels, and the strip panels do not project laterally beyond the jars. Moreover, the length of the bottom forming panels is such that, as can be seen in FIG. 2, they project between the side wall forming panels of the opposite wall as far as the outer edge of the strip panel 14 of the opposite wall. The whole effect is to make a stable package which does not require any further means for holding it together. For example, the package can be lifted by holding the central jar or by taking hold of the top panel, and will remain in the configuration shown in FIG. 2. A greater degree of stability can however be obtained by arranging that alternate bottom forming panels from one side overlie the bottom forming panels from the other side, instead of all the bottom forming panels from one side overlying those from the other side. The package shown will readily come apart if the strip forming panels are drawn apart. To counteract this, the whole package can be overwrapped, for example with shrink wrapping. Additionally or alternatively, the bottom forming panels can be secured in their overlapping condition, for example by adhesive, or by a locking and latching arrangement of known type. One such arrangement is shown in FIG. 3, where each pair of overlapping bottom forming panels 16 has two oppositely arranged crescent shaped cuts 22, one in each panel. When the panels 16 are overlapped, the cuts 22 intersect, and by pressing the tongues formed by the cuts out of the plane of their respective panels they can be made to interlock, as shown in FIG. 3, so that the panels 16 are prevented from being slid apart.

In the foregoing Specification, the terms top and bottom have been used in relation to the package merely for convenience. There is no reason in principle why the panel 10 should not be considered the bottom, and the panels 16 the top of the package. In practice, since only one surface of the blank would normally be printed, it is convenient for the panel 10 to be the top, since its exposed surface can be printed simultaneously with the exposed surfaces of the side wall panels and the strip panels. However, for ease of packaging, the package may be more conveniently formed by temporarily making the panel 10 the bottom of the package, placing the articles upside down on the panel 10, raising the side wall panels and overlapping the panels 16 at the top. When the package has been completed, it can of course be inverted to its normal position in use. Other ways of making up the package can be employed as desired.

Figure 4:
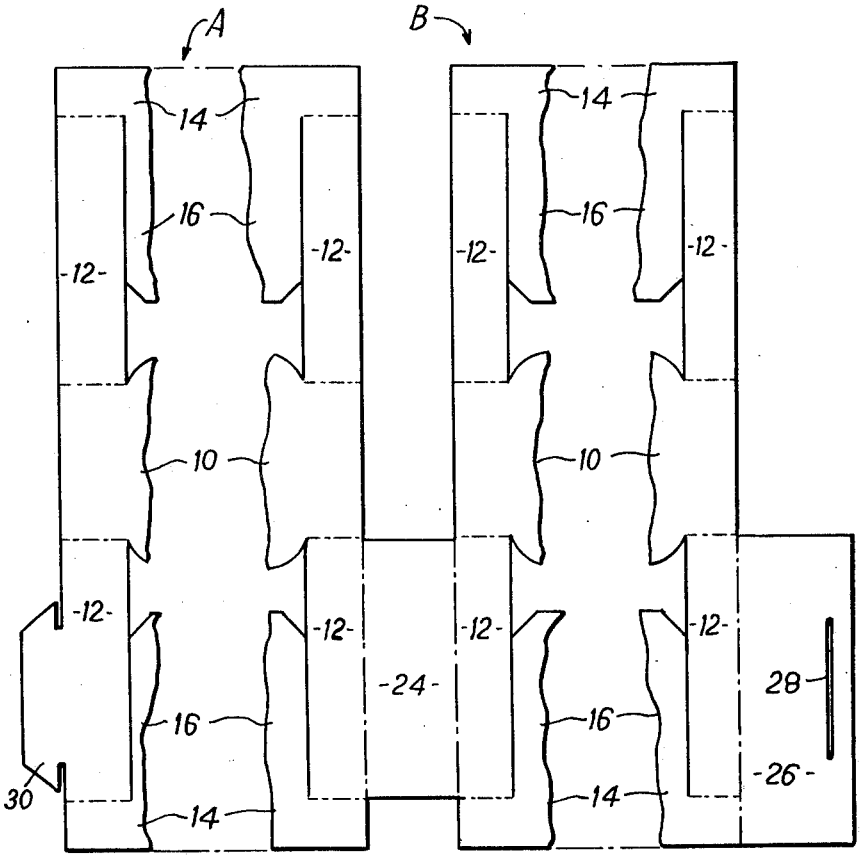
FIGS. 4 to 7 show various modifications to the blank of FIG. 1.
Figure 8:
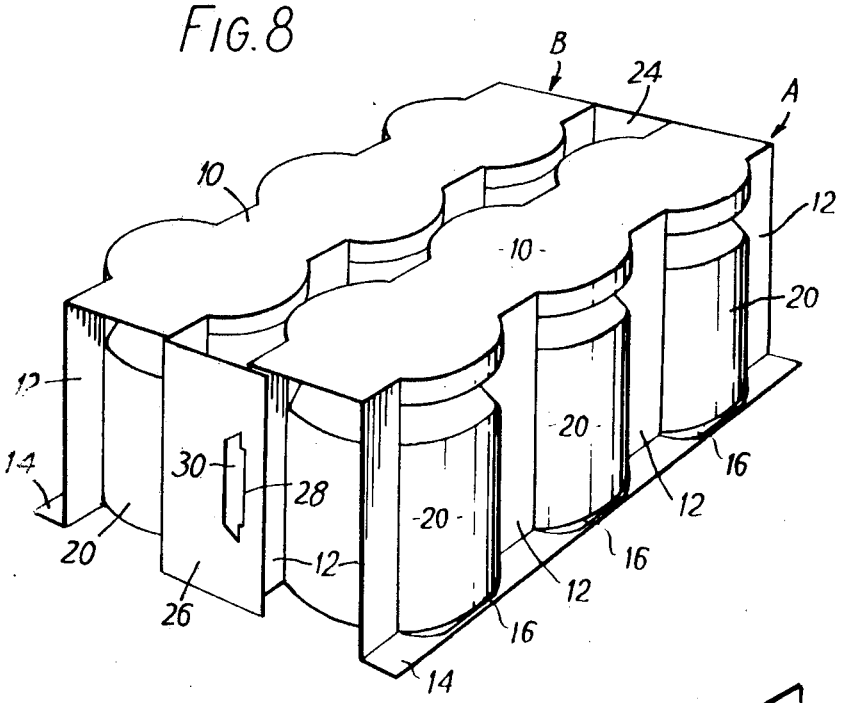
FIG. 8 shows a perspective view of a package made from the blank of FIG. 4.

FIG. 4 shows part of a modified blank comprising two parts A,B, each similar to the blank shown in FIG. 1, and arranged end to end and joined by a connecting panel 24 which is twice the width of a strip panel 14. The connecting panel 24 joins two adjacent side panels 12 of the parts A, B on one side only. On the same side at one end of the blank there is provided another panel 26, somewhat wider than the panel 24 and with a slot 28 to receive a tab 30 which is provided at the opposite end of the blank. By this means, the blank can be made up around two sets of articles such as the jars 20, and then the two parts A and B hinged about the connecting panel 24 so that the two sets of articles lie side by side, and can be retained in this position by inserting the tab 30 in the slot 28 of the panel 26. This is shown in FIG. 8.

Figure 5:
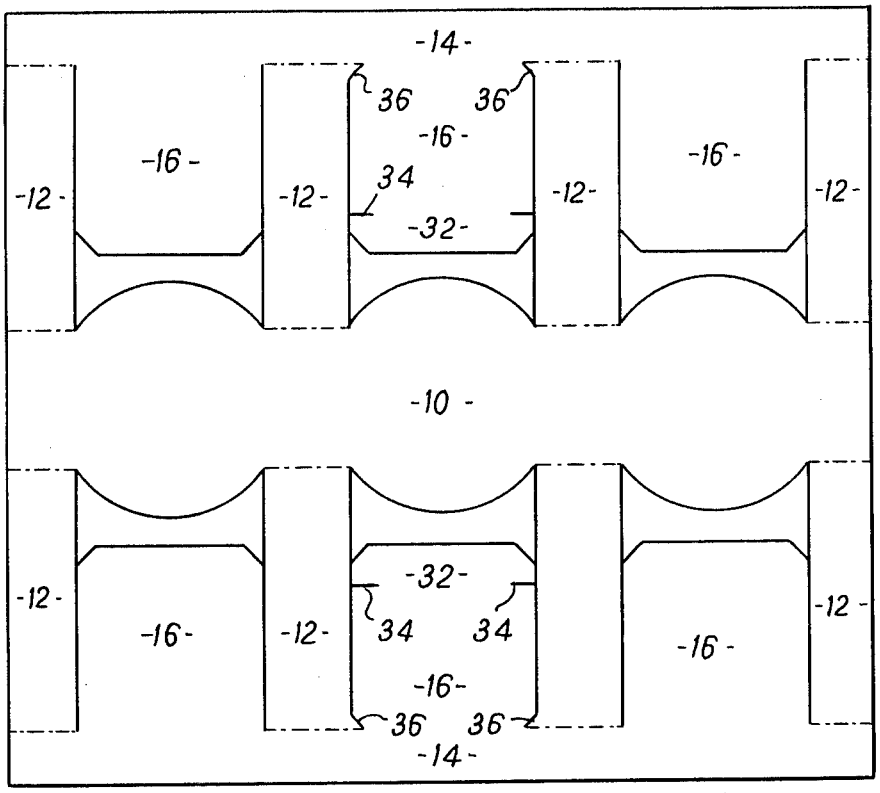

FIG. 5 shows a further modification of the blank of FIG. 1, in which the central panels 16 are each provided with a pair of short cuts 34 so as to form a locking tab 32 at the free end of the panel. The side panels 12 on either side of each central panel 16 have small triangular gussets 36 at the bottom. When the blank is made up as described above in relation to FIGS. 1 to 3, the overlying one of the central panels 16 will project between the opposite pair of side panels 12, and the gussets 36 thereof will engage in the slits 34, thereby locking the panels in position. Of course, only one of the central panels 16 will act in this way, but it is convenient to provide two sets of slits 34 and gussets 36 so that it will be immaterial which of the central panels 16 overlies the other. Similar slits and gussets could be provided on all the panels 16 and side panels 12, respectively, if desired.

Figure 6:
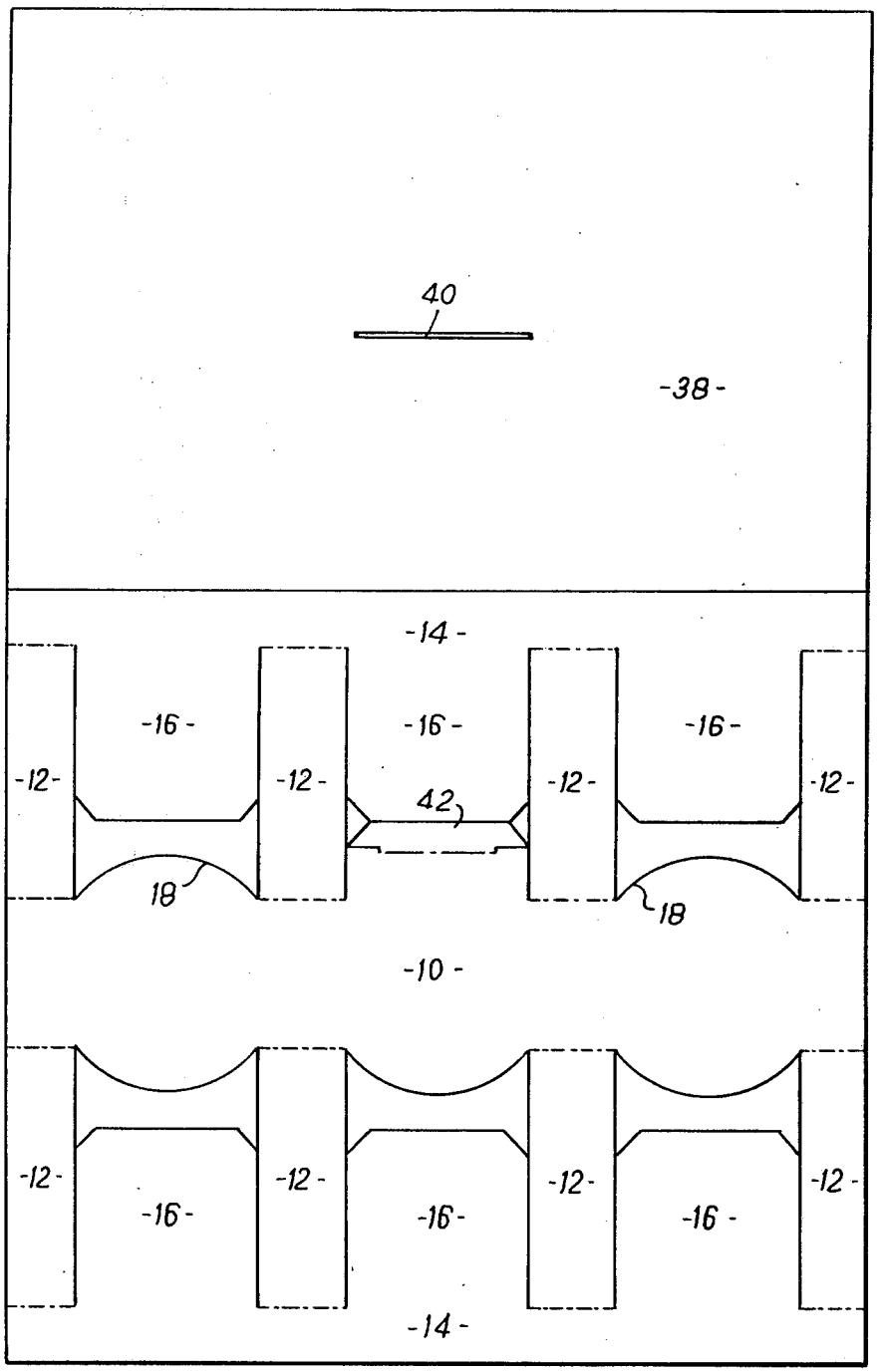
Figure 9:
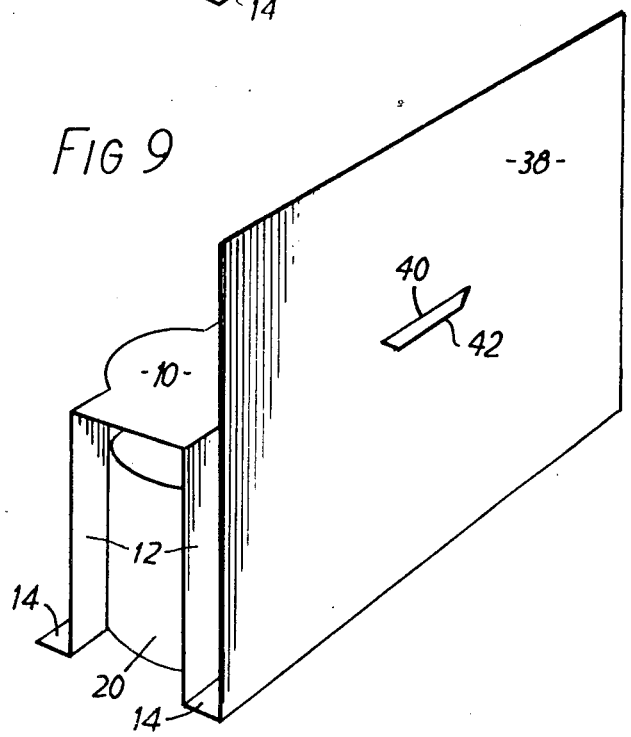
FIG. 9 shows a perspective view of a package made from the blank of FIG. 6.

FIG. 6 shows yet another modification of the blank of FIG. 1 in which an additional rectangular panel 38 is hinged to one of the strip panels 14. A locking tab 42 is provided in place of the central arcuate edge 18 on the side of the blank nearest the panel 38, and a slit 40 is formed in the panel 38 at a position in which it will receive the tab 42 when, in the erected condition of the blank as shown in FIG. 9, the panel 38 is raised. It will be apparent that the panel 38 will thus be retained in position and project somewhat above the top panel 10, thereby providing a display surface for advertising or other display material.

Figure 7:
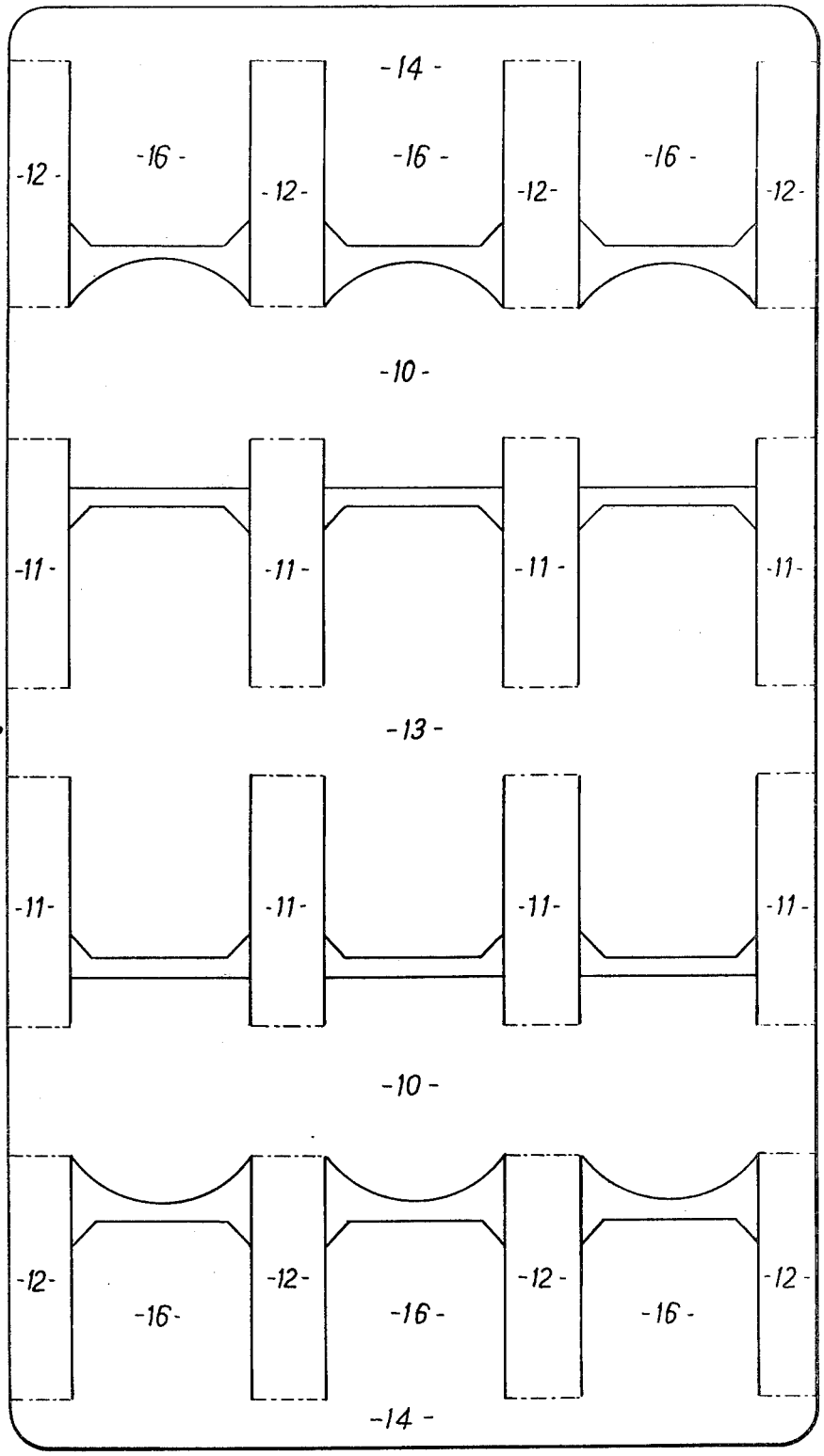
Figure 10:
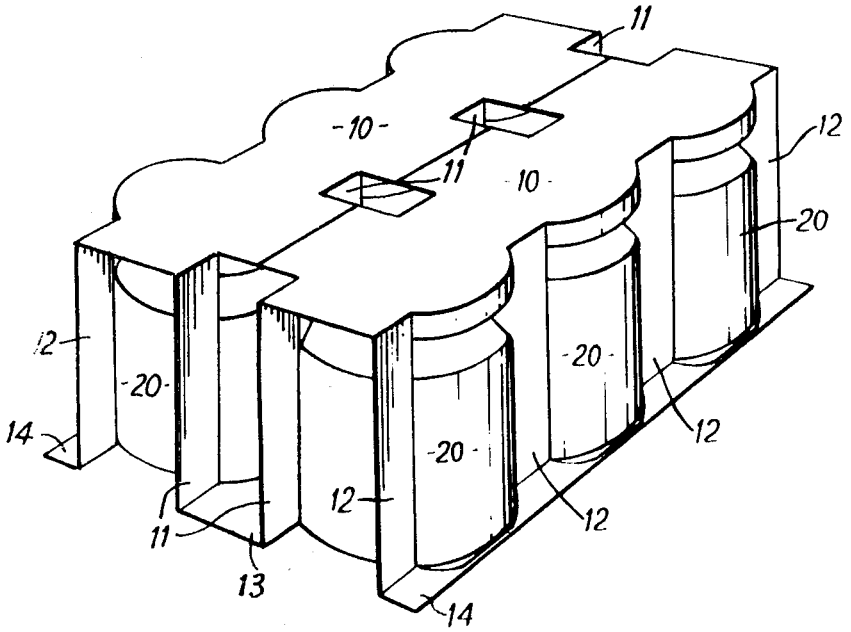
FIG. 10 shows a perspective view of a package made from the blank of FIG. 7.

FIG. 7 shows a still further modification of the blank of FIG. 1, in which the top forming panel 10 is formed in two parts separated by additional side panels 11 and a base panel 13. The area of the base panel corresponds to six articles 20 arranged in two rows of three. To erect the blank, firstly the two parts of the blank on either side of the base panel 13 are raised so that the side panels 11 are parallel and spaced apart. The articles 20 are then placed on the base panel 13 in two rows of three on either side of the side panels 11. Then the top panels 10 are folded mutually outwardly, the projecting portions along adjacent edges of the top panels abutting or overlapping, to form a composite top, and the side panels 12 are folded downwardly outside the articles 20, and the bottom panels 16 are turned inwardly to overlap the base panel 13 under the articles 20. There is thus formed a pack as shown in FIG. 10, somewhat similar to that shown in FIGS. 2 and 3, except that two rows of three articles are packaged side by side.

The present invention enables the packaged articles to be visible through the sides of the package throughout their entire height. The method of making up the package is very simple, and because the bottom forming portions are taken largely from material between the side wall forming panels, this type of blank uses less board than conventional sleeve forming blanks.

I claim:

1. A blank of foldable sheet material for forming into a sleeve for packaging at least one article, the blank having a top forming panel, a plurality of spaced apart side forming panels hinged to each side of the top forming panel, a pair of strip panels hingedly joining the side forming panels, and at least one opposite pair of bottom forming panels provided by the sheet material between adjacent side forming panels as coplaner extensions of the strip panels, with no hinge lines between the bottom forming panels and their respective strip panels, said opposite pair of bottom forming panels extending from their respective strip panels toward the top forming panel a sufficient distance such that when the side forming panels are turned in the same direction relative to the top forming panel and the strip panels are turned mutually outwardly, away from each other, with the bottom forming panels remaining coplaner with their respective strip panels and extending towards each other, they overlap each other.

2. A blank according to claim 1 wherein at least one panel of a said opposite pair of bottom forming panels extends from its respective strip panel by an amount greater than the distance between the hinge lines of opposite side forming panels with the top forming panel.

3. A blank according to claim 2 wherein the bottom forming panels of the or each pair extend from their respective strip panels by a similar amount.

4. A blank according to claim 1 including means for securing together an opposite pair of bottom forming panels when placed in overlapping relationship.

5. A blank according to claim 4 wherein said securing means comprises two generally arcuate cuts, one in each of the bottom forming panels of said pair and convex in the direction of the respective strip panel to define a pair of tongues which can be pressed out of the plane of their respective bottom forming panels for mutual interlocking engagement.

6. A blank according to claim 4 wherein said securing means comprises slots in opposite edges of a bottom forming panel which are engageable with projections on the mutually facing edges of the side forming panels on either side of the opposite bottom forming panel adjacent the hinge line with the associated strip panel.

7. A blank according to claim 6 wherein both bottom forming panels of a pair are provided with said slots, and said projections are provided on the side forming panels on either side of both of said pair of bottom forming panels.

8. A blank according to claim 1 comprising two sets of sleeve forming panels facing each other at adjacent ends, each set comprising a said top forming panel, said side forming panels, said strip panels and said bottom forming panels, the top forming panels being disposed end to end at said adjacent ends such that the two top forming panels lie along a common line, and two side forming panels of each set located on the edge of that set face similar side forming panels on the other set and are spaced apart therefrom by twice the width of each said strip panel, the two sets of panels being hingedly linked by a connecting panel joining two facing side forming panels at the said adjacent ends of the two sets on one side of the top forming panels, and means for linking together two side forming panels located at the ends of the two sets remote from the adjacent ends on said one side of the top forming panels when the two sleeves are hinged about said connecting panel so as to lie side by side.

9. A blank according to claim 8 wherein said linking means includes a panel hinged to one of said mutually remote side forming panels and adapted for connection to the other one.

10. A blank according to claim 1 comprising a plurality of sets of sleeve forming panels, each set comprising a said top forming panel, said side forming panels, said strip panels and said bottom forming panels, adjacent sets having one strip panel in common by which they are joined so that a plurality of sleeves side by side can be formed.

11. A blank according to claim 10 wherein the top forming panels along adjacent edges project towards each other in the regions between the side forming panels so as to abut or overlap in the erected condition of the sleeves.

12. A blank according to claim 1 including a further panel hinged to one of the strip panels so that it can be raised alongside the sleeve, and means for securing said further panel in the raised condition.

13. A blank according to claim 12 wherein said securing means comprises a tab projecting from the top forming panel for engagement in a slot in said further panel.

14. A package comprising a sleeve made up from a blank according to claim 1 around one or more articles, with the top forming panel abutting one end of the or each article, the side forming panels extending therefrom alongside the or each article so that the article is visible in the space between them, the strip panels being turned outwardly so that the bottom forming extension panels thereof project mutually inwardly to abut the other end of the or each article.

15. An article carrying package made from a single integral piece of foldable sheet material and adapted to package articles of a given width, said package having a top forming panel overlying the top of the article or each article, a plurality of spaced apart side forming panels hinged to each side of the top forming panel along first hinge lines located on opposite sides of the top forming panel, a pair of strip panels hingedly joining the side forming panels along second hinge lines, said strip panels bent to extend mutually outwardly away from the articles in a plane located between the articles, and at least one opposite pair of bottom forming panels located between adjacent side forming panels as coplanar extensions of said strip panels, each opposite pair of bottom forming panels overlapping each other beneath the article.

16. A package according to claim 15, wherein at least one panel of said opposite pair of bottom forming panels extends from its respective strip panel beneath the article by an amount greater than the distance between the strip panels.

17. A package according to claim 16, wherein the bottom forming panel of the or each pair extend from their respective strip panels beneath the article by a similar amount.

18. A package according to claim 15, including means for securing together said opposite pair of bottom forming panels in said overlapping relationship.

* * * * *

UNITED STATES PATENT OFFICE

CERTIFICATE OF CORRECTION

PATENT NO. : 4,166,534

DATED : September 4, 1979

INVENTOR(S) : JAMES BOWDEN

It is certified that error appears in the above-identified patent and that said Letters Patent are hereby corrected as shown below:

Please add the following to the heading of the above patent:

--[73] Assignee: DRG PACKAGING LIMITED, Bristol, England --.

Signed and Sealed this

*Twenty-sixth* Day of *February 1980*

[SEAL]

*Attest:*

SIDNEY A. DIAMOND

*Attesting Officer*

*Commissioner of Patents and Trademarks*